US006105682A

United States Patent [19]

Recker et al.

[11] Patent Number: 6,105,682

[45] Date of Patent: Aug. 22, 2000

[54] APPARATUS FOR CONTROLLING AN EARTHWORKING IMPLEMENT HAVING FOUR DEGREES OF FREEDOM

[75] Inventors: Roger L. Recker, Dunlap; Bryan G. Lammers, Washington, both of Ill.

[73] Assignee: Caterpillar Inc., Peoria, Ill.

[21] Appl. No.: 09/204,383

[22] Filed: Dec. 2, 1998

[51] Int. Cl.[7] ..... E02F 3/76

[52] U.S. Cl. ..... 172/811; 172/819

[58] Field of Search ..... 172/2, 3, 4, 4.5, 172/7, 811, 818, 810, 819, 820, 821, 822, 823, 824, 825, 826

[56] References Cited

U.S. PATENT DOCUMENTS

| | | | |
|---|---|---|---|
| 3,631,931 | 1/1972 | Frisbee | 172/807 |
| 3,773,115 | 11/1973 | Asal | 172/803 |
| 3,795,280 | 3/1974 | Casey | 172/804 |
| 3,913,684 | 10/1975 | Casey et al. | 172/804 |
| 4,078,616 | 3/1978 | Hisamatsu et al. | 172/801 |
| 4,151,920 | 5/1979 | Shoup | 414/697 |
| 4,167,979 | 9/1979 | Freese et al. | 172/801 |
| 4,221,267 | 9/1980 | Asal et al. | 172/804 |
| 4,266,625 | 5/1981 | Garner et al. | 180/6.48 |
| 4,364,439 | 12/1982 | Asal | 172/821 |
| 4,934,463 | 6/1990 | Ishida et al. | 172/4.5 |
| 4,962,816 | 10/1990 | Imon et al. | 172/821 |
| 5,010,961 | 4/1991 | Frisbee | 172/821 |
| 5,058,685 | 10/1991 | Moffitt | 172/820 |
| 5,535,830 | 7/1996 | Matsushita et al. | 172/7 |

*Primary Examiner*—Thomas B. Will
*Assistant Examiner*—Nathan Mammen
*Attorney, Agent, or Firm*—Steve D. Lundquist

[57] ABSTRACT

An apparatus for controlling an earthworking implement. The earthworking implement is movably attached to a track-type tractor having a main frame and a track roller frame. The track roller frame is located on a left and a right side of the main frame. The apparatus includes a c-frame attached to inner portions of the track roller frame at positions toward a forward portion of the track-type tractor. The apparatus also includes four independently operable hydraulic cylinders attached to one of the main frame and the c-frame. Each of the hydraulic cylinders has a head end located toward the attachment to the one of the main frame and the c-frame, and a rod end located substantially vertically upwards of the head end. The apparatus also includes an earthworking blade attached to each of the rod ends of the hydraulic cylinders and to the c-frame.

12 Claims, 6 Drawing Sheets

APPARATUS FOR CONTROLLING AN EARTHWORKING IMPLEMENT HAVING FOUR DEGREES OF FREEDOM

TECHNICAL FIELD

This invention relates generally to an apparatus for controlling an earthworking implement and, more particularly, to an apparatus for controlling an earthworking implement having four degrees of freedom.

BACKGROUND ART

Earthworking machines, such as track-type tractors, are used to move earth for various purposes, e.g., shape terrain to desired contours, remove overburden to expose ore, and the like. An earthworking implement movably attached to the earthworking machine, for example a bulldozer blade, is used to perform the work.

Earthworking blades have been designed to achieve productive and efficient results from the work being performed. Among the desired design characteristics are various mounting structures, both for the blade and for hydraulic cylinders used to control movement of the blade. Typically, however, the designed structures must conform to physical constraints, which limits the degrees of freedom, i.e., motion, of the blade.

For example, typical earthworking blades on track-type tractors are configured for three degrees of freedom, while a fourth degree of freedom is compromised to maintain the structural integrity of the apparatus under heavy load conditions. For example, a blade structure may be configured to allow lift, tilt, and angle motions, but pitch motion is only accessible by changing the mounting position of the blade. Other blades may have lift, tilt, and pitch motions, but sacrifice angle motion to allow the blade to push very heavy loads.

It is often desired to have a blade configuration, including the configuration of the hydraulic control cylinders, which allows four degrees of freedom, i.e., lift, pitch, tilt, and angle, in a work environment.

The present invention is directed to overcoming one or more of the problems as set forth above.

DISCLOSURE OF THE INVENTION

In one aspect of the present invention an apparatus for controlling an earthworking implement is shown. The earthworking implement is movably attached to a track-type tractor having a main frame and a track roller frame. The track roller frame is located on a left and a right side of the main frame. The apparatus includes a c-frame attached to inner portions of the track roller frame at positions toward a forward portion of the track-type tractor. The apparatus also includes four independently operable hydraulic cylinders attached to one of the main frame and the c-frame. Each of the hydraulic cylinders has a head end attached to the one of the main frame and the c-frame, and a rod end located substantially vertically upwards of the head end. The apparatus also includes an earthworking blade attached to each of the rod ends of the hydraulic cylinders and to the c-frame.

BEST MODE FOR CARRYING OUT THE INVENTION

Figure 1:
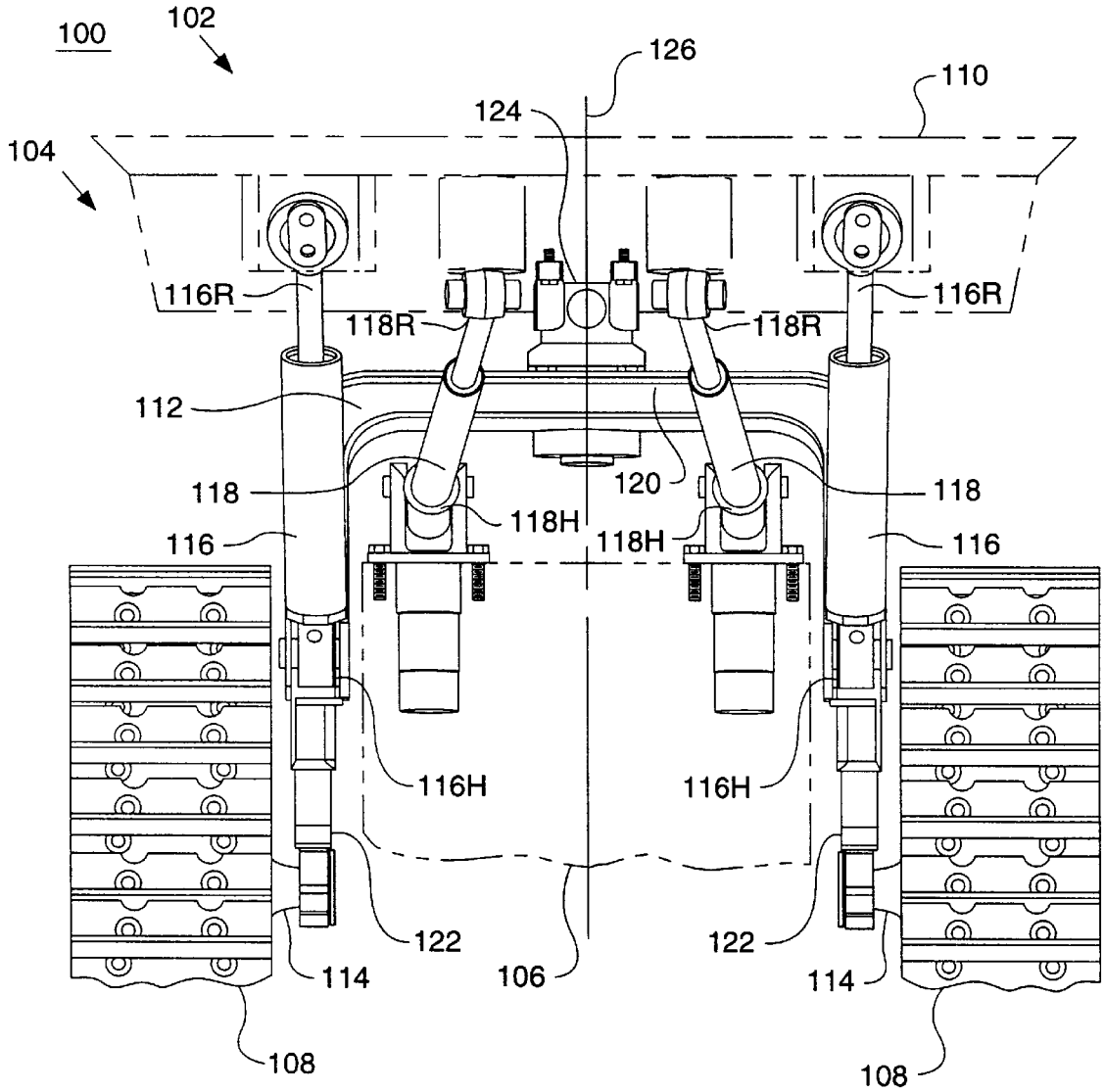
FIG. 1 is a diagrammatic illustration of a preferred embodiment of the present invention as viewed from above.
Figure 2:
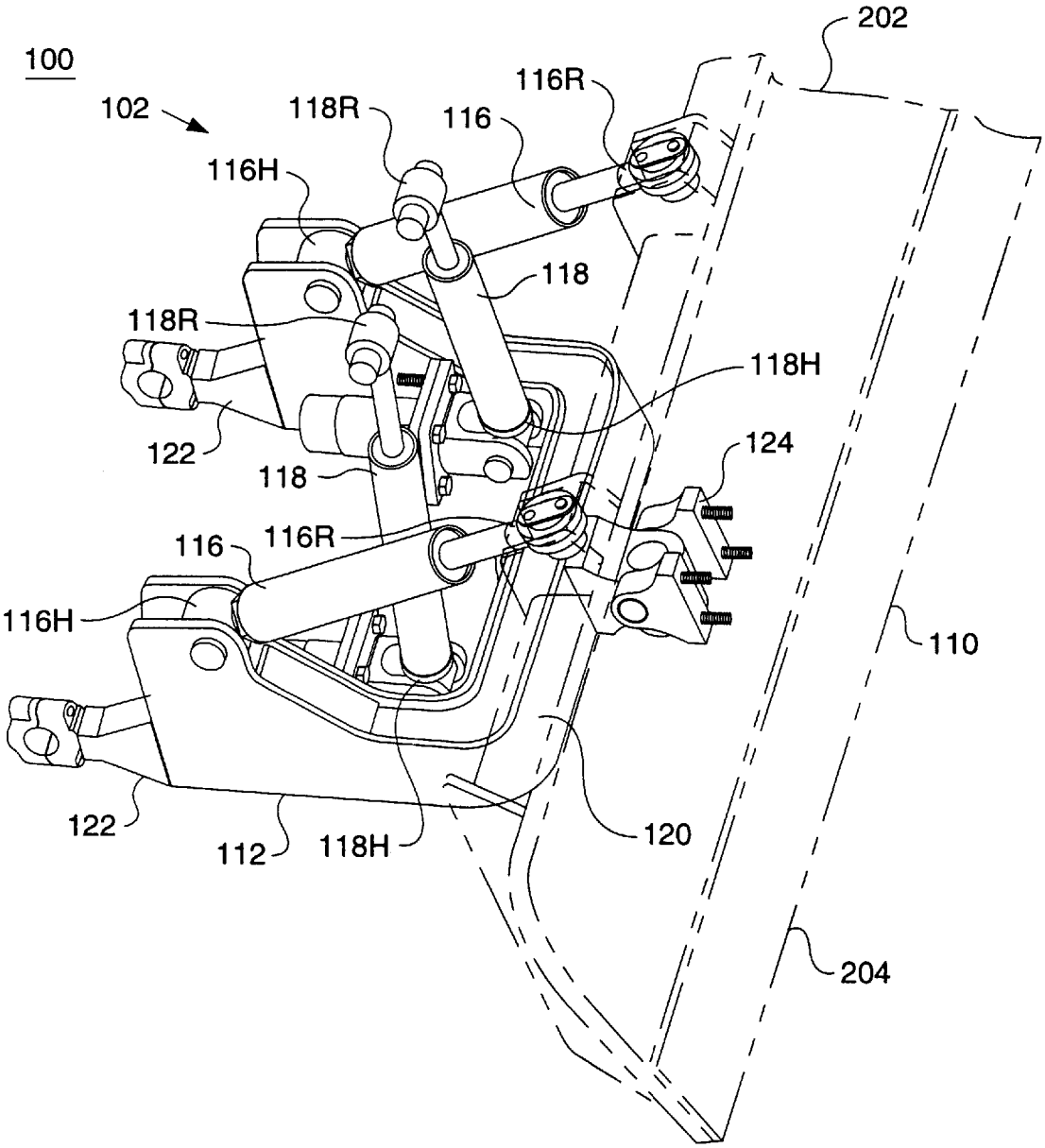
FIG. 2 is a diagrammatic illustration of a preferred embodiment of the present invention as viewed from a second perspective.
Figure 3:
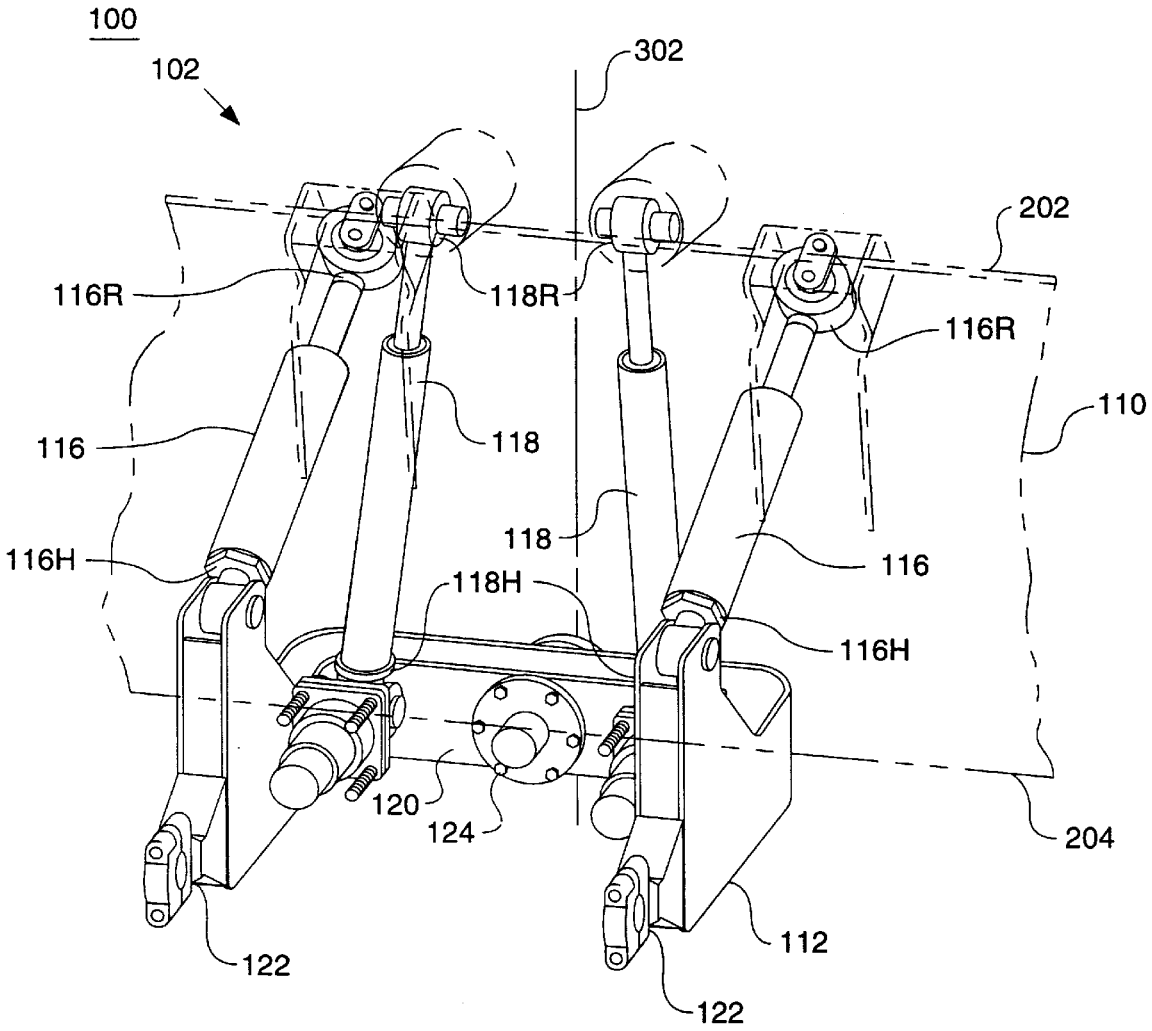
FIG. 3 is a diagrammatic illustration of a preferred embodiment of the present invention as viewed from a third perspective.
Figure 4:
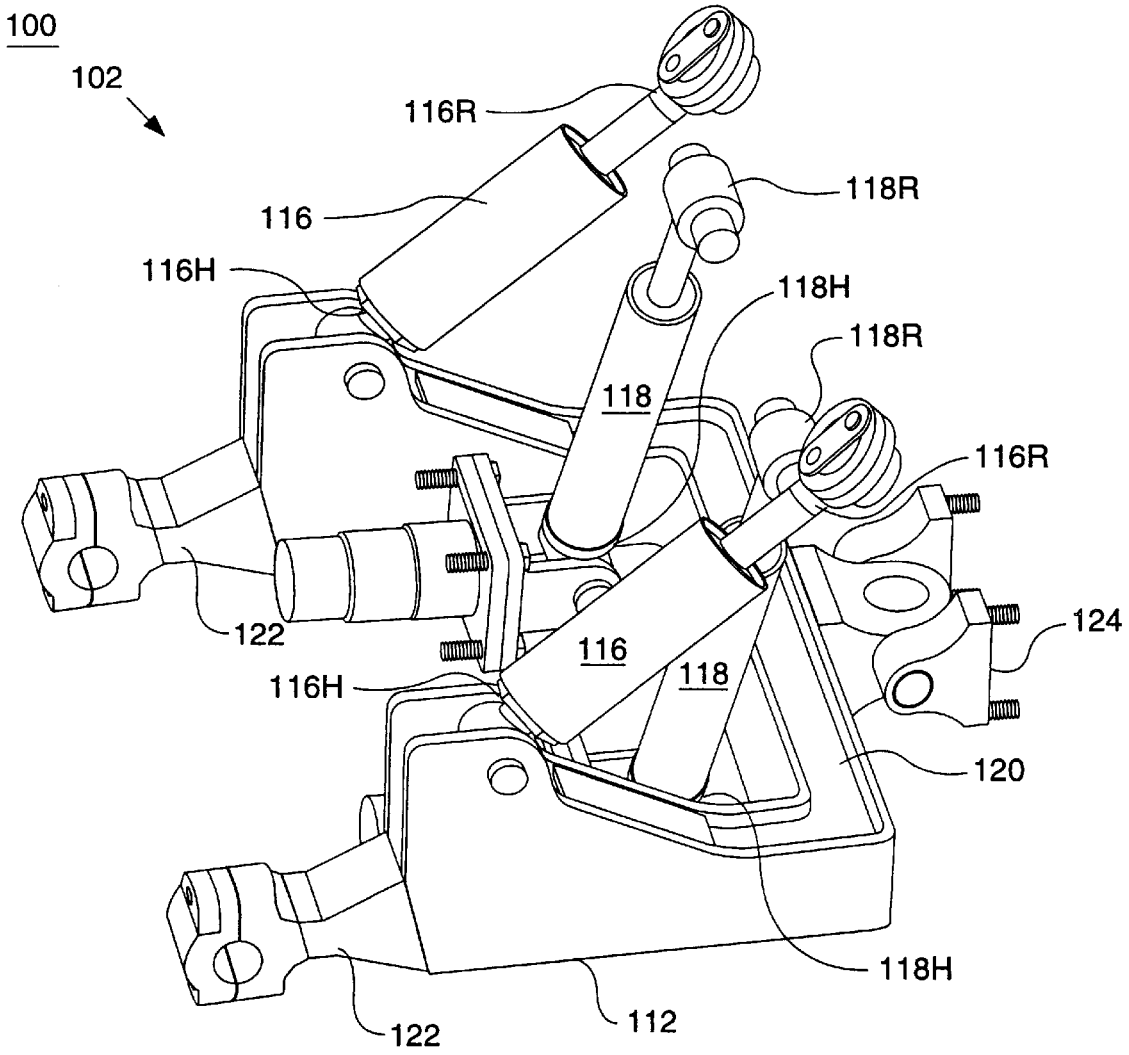
FIG. 4 is a diagrammatic illustration of a preferred embodiment of the present invention as viewed from a fourth perspective.

Referring to the drawings, and in particular, referring to FIGS. 1–4, various views diagrammatically illustrating a preferred embodiment of the present invention are shown. The present invention, as embodied, is an apparatus 100 for controlling an earthworking implement 102 having four degrees of freedom. The earthworking implement 102 is movably attached to a track-type tractor 104 having a main frame 106 and a track roller frame 108. The track roller frame 108 is located on a left and a right side of the main frame 106 of the track-type tractor 104.

Figure 5:
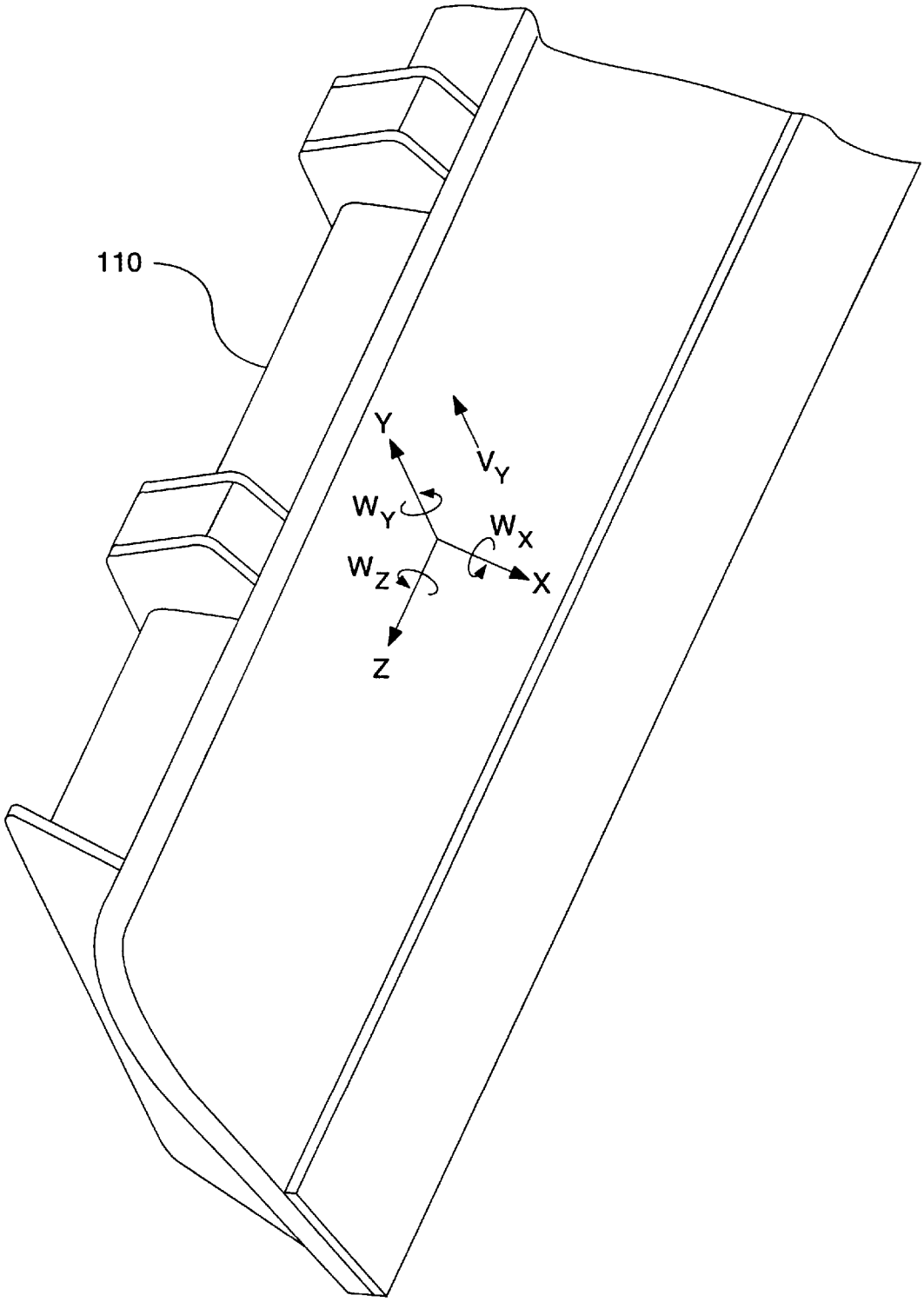
FIG. 5 is a diagrammatic illustration of a coordinate system depicting four degrees of freedom of a bulldozer blade.

Referring briefly to FIG. 5, a diagrammatic illustration of an earthworking implement 102 with respect to a coordinate system is shown. The earthworking implement 102 shown is a blade 110 of a track-type tractor 104. Preferably, the coordinate system is a Cartesian coordinate system. The four degrees of freedom of the blade 110 are defined by the coordinate system, in free space, as $V_Y$ (lift), $W_X$ (tilt), $W_Y$ (angle), and $W_Z$ (pitch)

With continued reference to FIGS. 1–4, in the preferred embodiment, a c-frame 112 is pivotally attached to inner portions of the track roller frame 108 at positions toward a forward portion of the track-type tractor 104, depicted in FIG. 1 as c-frame to track roller frame attachments 114. The c-frame 112 has a front portion 120 having two ends. Each end curves in a substantially perpendicular direction from the front portion 120 into arm portions 122. Each arm portion 122 is attached to the track roller frame 108 at ends of the arm portions 122 away from the front portion 120. The c-frame 112 is configured such that the front portion 120 raises and lowers when the arm portions 122 pivot with respect to the track roller frame 108.

In previous track-type tractor configurations using a c-frame, the c-frame is either mounted to the outside of the track roller frame, or to the main frame. The configuration of the present invention, i.e., mounting the c-frame 112 to the inside of the track roller frame 108, provides protection of the linkage joints not available when the c-frame is mounted to the outside of the track roller frame, and provides greater stability than when the c-frame is mounted to the main frame.

Preferably, four independently operable hydraulic cylinders 116,118 are pivotally attached to one of the main frame 106 and the c-frame 112. Each of the hydraulic cylinders 116,118 has a head end 116H,118H which is attached to one of the main frame 106 and the c-frame 112. In addition, each of the hydraulic cylinders 116,118 has a rod end 116R,118R which is located at the other end of the cylinders 116,118 in a direction substantially vertically upwards of the head ends 116H,118H. By mounting the hydraulic cylinders 116,118 with the rod ends 116R,118R directed upwards, the cylinders 116,118 are in effect pushing the earthworking implement 102 upwards when lifting. Conventional cylinder configurations, i.e., with the head ends directed upwards, are pulling the earthworking implement up when lifting. The advantage of configuring the cylinders with the rod ends up is that the lift capacity of the cylinders is increased by the action of pushing, rather than pulling the load.

The rod ends 116R,118R of the hydraulic cylinders 116, 118 are attached to an upper portion 202 of the blade 110. A lower portion 204 of the blade 110 is pivotally attached to the c-frame 112 at a location on the c-frame 112 near the center of the front portion 120, depicted in FIGS. 1–4 as a blade to c-frame attachment 124. In one embodiment, the blade 110 is attached to the c-frame 112 by means of a ball joint. In another embodiment, the blade 110 is attached to the c-frame 112 by means of a two pin universal joint. It is understood that other means for pivotally attaching the blade 110 to the c-frame 112 could be used so that the blade 110 may be pivoted in all directions relative to the c-frame 112.

In the preferred embodiment, the rod ends 116R,118R of the hydraulic cylinders 116,118 are trunnion mounted to the blade 110. Additionally, the head ends 116H,118H of the hydraulic cylinders 116,118 are trunnion mounted to one of the main frame 106 and the c-frame 112. However, other methods for providing pivotal connections of the cylinders 116,118 could be used without deviating from the spirit of the invention.

Two of the four hydraulic cylinders 116 are located generally in line and parallel with the arm portions 122 of the c-frame 112. These two cylinders 116 are pitch and angle cylinders 116, and are used generally to control the pitch and angle of the blade 110. The head ends 116H of the pitch and angle cylinders 116 are attached to the arm portions 122 of the c-frame 112.

The other two of the four hydraulic cylinders 118 are located inward of the pitch and angle cylinders 116 relative to the center portion of the c-frame 112. These two cylinders 118 are lift and tilt cylinders 118 and are used generally to control the lift and tilt of the blade 110. The head ends 118H of the lift and tilt cylinders 118 are attached to the main frame 106 at substantially similar distances from a longitudinal axis 126 along the center of the track-type tractor 104.

Preferably, the rod ends 118R of the lift and tilt cylinders 118 are attached to the upper portion 202 of the blade 110 at substantially similar distances from a centerline 302 extending vertically through the center of the blade 110. In addition, the distance of the head ends 118H of the lift and tilt cylinders 118 from the longitudinal axis 126 is preferably greater than the distance of the rod ends 118R of the lift and tilt cylinders 118 from the centerline 302 to provide greater stability, load capacity, and range of motion.

Industrial Applicability

In operation, the configuration described above provides unique advantages over other existing implement configurations. The independent control of each of the four hydraulic cylinders 116,118 allows an operator, preferably with the aid of a control processor, to move the blade 110 in any one degree of freedom while maintaining the planes of the other three degrees of freedom intact.

Figure 6:
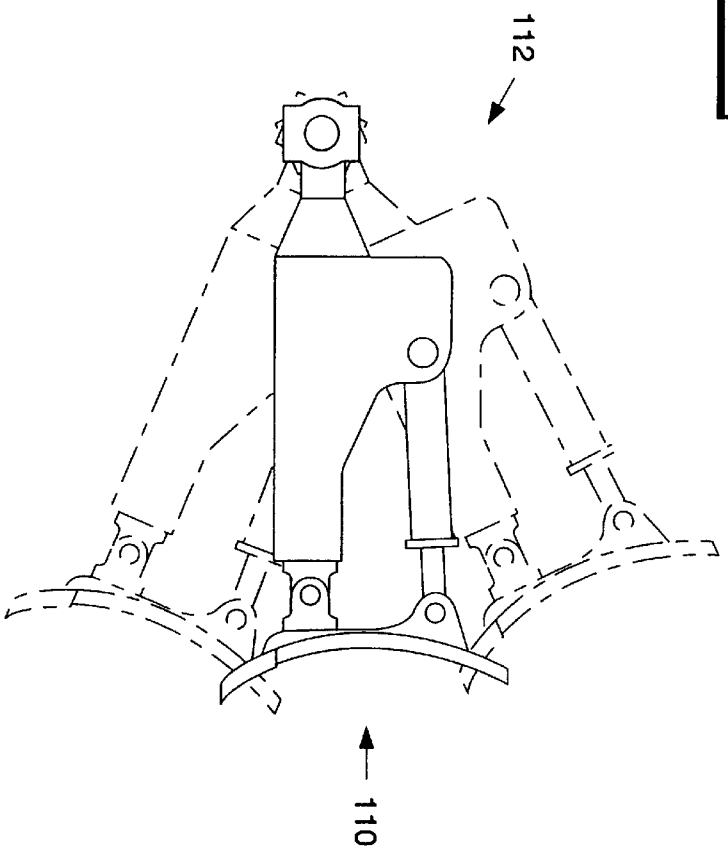
FIG. 6 is a diagrammatic illustration of a blade being raised and lowered by a c-frame.
Figure 7:
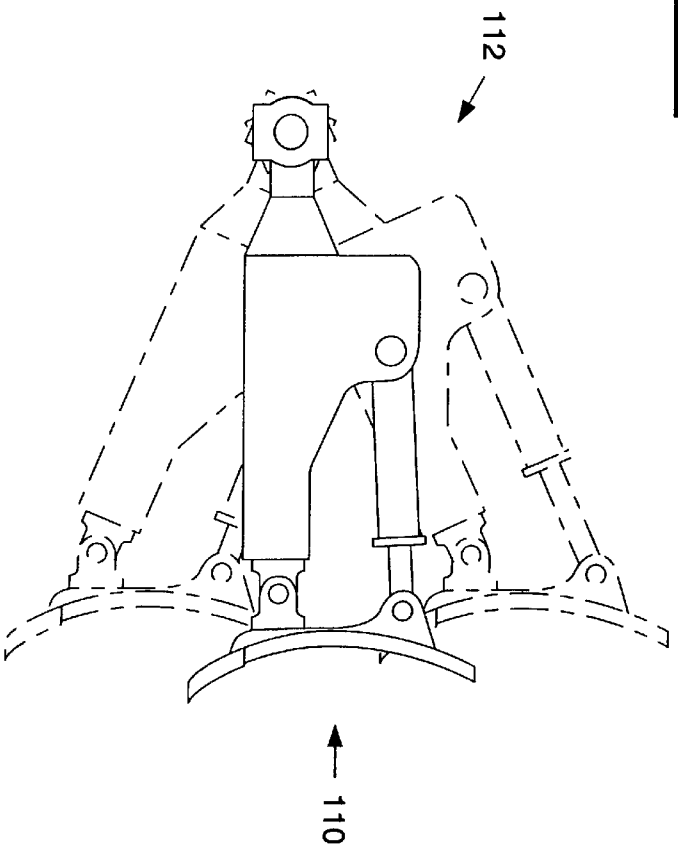
FIG. 7 is a diagrammatic illustration of a blade being raised and lowered by a c-frame as embodied with the present invention.

An example of this single degree of freedom control is shown in FIGS. 6 and 7. In FIG. 6, a typical motion to lift the blade 110 results in the blade 110 traveling about the arc formed by the pivoting motion of the c-frame 112. This movement results in the pitch of the blade 110 to change as the blade 110 is raised and lowered.

In FIG. 7, however, as the blade 110 is raised and lowered, the present invention is adapted to be able to compensate for changes in pitch of the blade 110. The independent control of each of the hydraulic cylinders 116,118 allows an operator to raise and lower the blade 110 without affecting the planar position of the blade 110 in the other three degrees of freedom, i.e., pitch, tilt, and angle.

In general, the blade 110 can be moved with respect to any degree of freedom, e.g., lift, pitch, tilt, and angle, without undesired movement in any of the other three degrees of freedom.

Other aspects, objects, and features of the present invention can be obtained from a study of the drawings, the disclosure, and the appended claims.

What is claimed is:

1. An apparatus for controlling an earthworking implement having four degrees of freedom, the earthworking implement being movably attached to a track-type tractor having a main frame and a track roller frame, the track roller frame being located on a left and a right side of the main frame of the track-type tractor, comprising:

a c-frame pivotally attached to inner portions of the track roller frame at positions toward a forward portion of the track-type tractor;

four independently operable hydraulic cylinders, each cylinder being pivotally attached to one of the main frame and the c-frame, each of the hydraulic cylinders having a head end located toward the attachment to the one of the main frame and the c-frame and a rod end located substantially upwards of the head end; and an earthworking blade having an upper portion pivotally attached to each of the rod ends of the four hydraulic cylinders, and a lower portion pivotally attached to the c-frame.

2. An apparatus, as set forth in claim 1, wherein the four degrees of freedom include lift, pitch, tilt, and angle.

3. An apparatus, as set forth in claim 1, wherein the rod ends of the hydraulic cylinders are trunnion mounted to the blade and the head ends of the hydraulic cylinders are trunnion mounted to one of the main frame and the c-frame.

4. An apparatus, as set forth in claim 1, wherein the c-frame includes a front portion having two ends and two arm portions curving in a substantially perpendicular direction from each end of the front portion, the two arm portions being attached to the track roller frame at ends of the arm portions away from the front portion.

5. An apparatus, as set forth in claim 4, wherein the lower portion of the blade is attached to a center portion of the front portion of the c-frame.

6. An apparatus, as set forth in claim 5, wherein the lower portion of the blade is attached to the c-frame by a ball joint.

7. An apparatus, as set forth in claim 5, wherein the lower portion of the blade is attached to the c-frame by a two pin universal joint.

8. An apparatus, as set forth in claim 4, wherein two of the four hydraulic cylinders are located generally in line and parallel with the arm portions of the c-frame, the two cylinders being pitch and angle cylinders used generally to control the pitch and angle of the blade, the pitch and angle cylinders having the head ends attached to the arm portions of the c-frame.

9. An apparatus, as set forth in claim 8, wherein the other two of the four hydraulic cylinders are located inward of the pitch and angle cylinders relative to the center portion of the c-frame, the other two cylinders being lift and tilt cylinders used generally to control the lift and tilt of the blade, the lift and tilt cylinders having the head ends attached to the main frame.

10. An apparatus, as set forth in claim 9, wherein the head ends of the lift and tilt cylinders are attached to the main frame at substantially similar distances from a longitudinal axis along the center of the track-type tractor.

11. An apparatus, as set forth in claim 10, wherein the rod ends of the lift and tilt cylinders are attached to the upper portion of the blade at substantially similar distances from a centerline extending vertically through the center of the blade.

12. An apparatus, as set forth in claim 11, wherein the distance of the head ends of the lift and tilt cylinders from the longitudinal axis is greater than the distance of the rod ends of the lift and tilt cylinders from the centerline.

* * * * *